US005950532A

United States Patent [19]

Bielfeldt

[11] Patent Number: 5,950,532

[45] Date of Patent: Sep. 14, 1999

[54] CONTINUOUSLY WORKING PRESS

[75] Inventor: Friedrich B. Bielfeldt, Paehl, Germany

[73] Assignee: Machinenfabrik J. Dieffenbacher GmbH & Co., Eppingen, Germany

[21] Appl. No.: 08/867,650

[22] Filed: Jun. 2, 1997

[30] Foreign Application Priority Data

Jun. 3, 1996 [DE] Germany ..... 196 22 204

[51] Int. Cl.[6] ..... B30B 5/06; B30B 15/34; B27N 3/24

[52] U.S. Cl. ..... 100/311; 100/154; 156/583.5; 425/371

[58] Field of Search ..... 100/151–154, 100/306–314; 156/583.5; 425/371

[56] References Cited

U.S. PATENT DOCUMENTS 3,202,090 8/1965 Alenius ..... 100/311
3,910,179 10/1975 Troutner ..... 100/154
3,985,489 10/1976 De Mets ..... 425/371
4,938,126 7/1990 Rubio et al. ..... 100/151

FOREIGN PATENT DOCUMENTS 44 00 347 7/1995 Germany .

*Primary Examiner*—Stephen F. Gerrity
*Attorney, Agent, or Firm*—Foley & Lardner

[57] ABSTRACT

A continuously operating press for the production of particleboards, fiberboards or similar wooden-material boards and plastic sheets allows for the free longitudinal expansion or contraction of the press heating plates by having a press force frame structure of individual press frames positioned between support carriers and mounted on sliding members on the lower support carriers. The sliding members are designed as rolling wheel segments that are assigned to each individual frame of the press force support structure.

16 Claims, 5 Drawing Sheets

CONTINUOUSLY WORKING PRESS

BACKGROUND OF THE INVENTION

1. Field of the Invention

The invention relates to a continuously operating press for producing particleboards, fiberboards, plywood boards or similar wooden-material boards and plastic sheets.

2. Description of the Related Art

A continuously operating press is known from, for example, German Patent No. DE-A 44 00 347. The object of DE-A 44 00 347 is to configure a continuously operating press such that, in the event of a change in the temperature profile due to the introduction or removal of heat into or from the press heating plates, the resulting expansion or contraction of the press heating plates cause no detrimental effects on the cylinder packings and piston packings arranged between the press heating plates and the press beam support structures, on the guides, and on the insulating elements. Another object of DE-A 44 00 347 is to provide a continuously operating press capable of a just-in-time production, i.e., a production change on-the-fly, to allow a change in thickness of the material to be pressed to cause a technically required change in the temperature profile during continuous operation without relaxation of the pressure and force, i.e. without interruption.

The solution provided in DE-A 44 00 347, has been proven in practice. However, one major drawback is that dirt particles gather on the lower support carriers, causing slipping/sticking which sometimes lead to faults due to vibrations in the sliding movement of the individual frames.

SUMMARY OF THE INVENTION

An object of the invention is to provide an improved continuously operating press that alleviates the slipping/sticking problem.

The above and other objects of the invention are accomplished by a continuously operating press comprising a press force support structure positioned between an upper and a lower support carriers, the press force support structure including a plurality of individual frames each having a rolling wheel segment; and press heating plates supported on the press force support structure. The continuously operating press according to the invention has a sliding resistance that is insensitive to dirt during the longitudinal expansion or contraction of the press heating plates in the case where the individual frames are supported on the lower support carriers, and a reduced sliding resistance such that the individual press frames can move without interference over the entire length of the press in the preloaded system between the entry and exit crossbeams.

In order to minimize the sliding resistance, in the case where the individual frames are supported on the lower support carriers, during the longitudinal change (expansion or contraction) of the press heating plates, a rolling wheel segment is preferably provided. This rolling wheel segment is arranged so that the sliding pin and the rolling wheel segment have the same rotation point E. The ratio of the sliding pin radius r to rolling wheel segment radius R is selected such that, with the rolling support, due to the leverage ratio, a rolling frictional resistance of $\mu \leqq 0.5$ (preferably of 0.05) is produced. The dimensioning rule is based on the fact that the sliding resistance in the sliding pin of $\mu max \approx 0.4$ multiplied by the ratio $r:R \approx 0.15:0.2$ is reduced, for example, with r:R=60:300, and a rolling frictional resistance of about 0.08 is set on the running surface of the rolling wheel segment. Slipping/sticking effects are reliably prevented, since the dirt particles are rolled flat by the rolling roller effect, i.e., the rolling effect of the rolled wheel segment. As a result, the rolling movement of the continuously operating press is completely insensitive to dirt in the event of expansion or contraction on the support carriers. A rolling wheel segment is more advantageous than a complete wheel, because expansion movements have to be only partially compensated and, moreover, savings can be made in the structural height.

Additional objects, features and advantages of the invention will be set forth in the description of preferred embodiments which follows.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

DETAILED DESCRIPTION OF THE PREFERRED EMBODIMENTS

Figure 1:
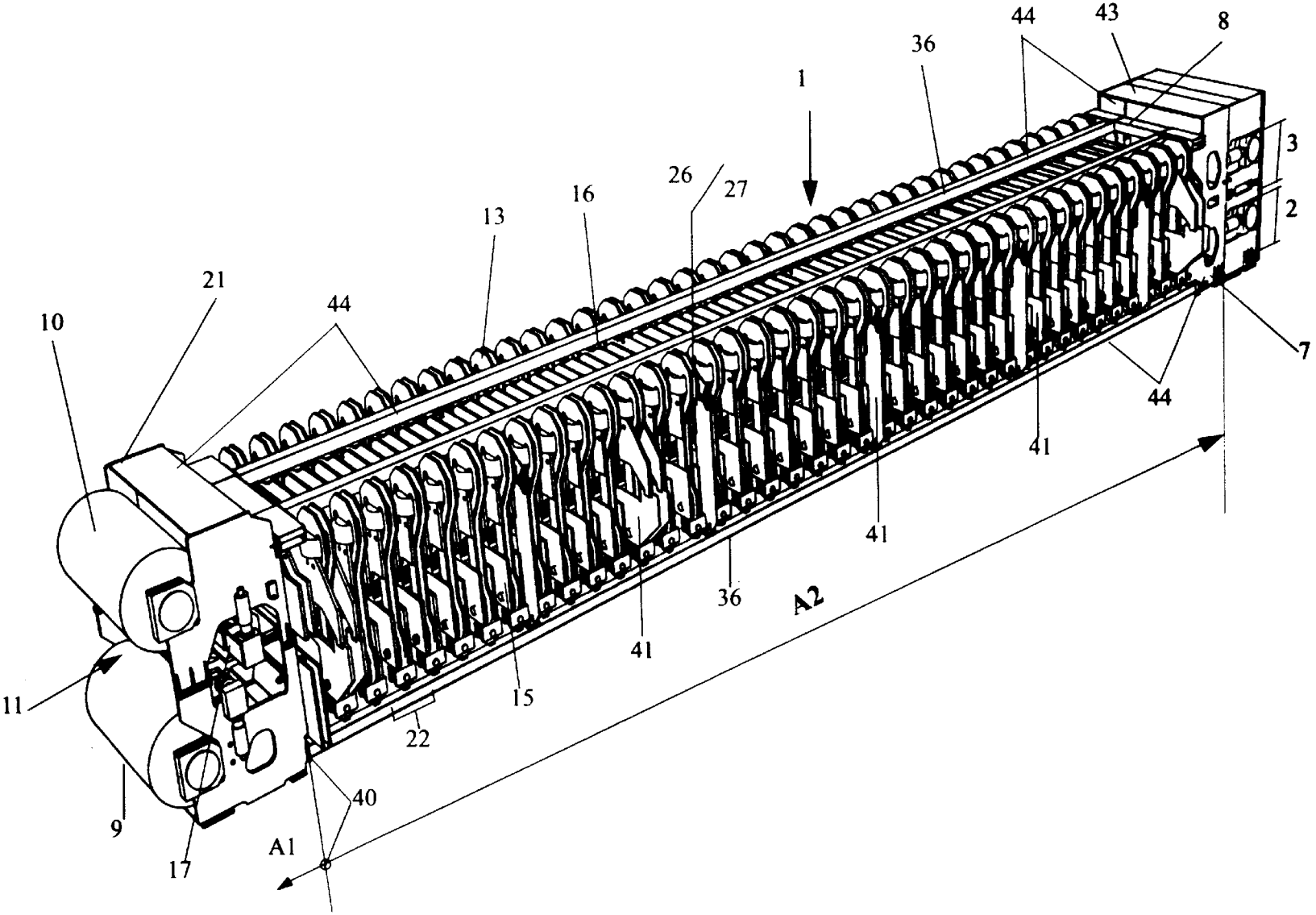
FIG. 1 shows a perspective representation of the continuously operating press according to the invention.
Figure 2:
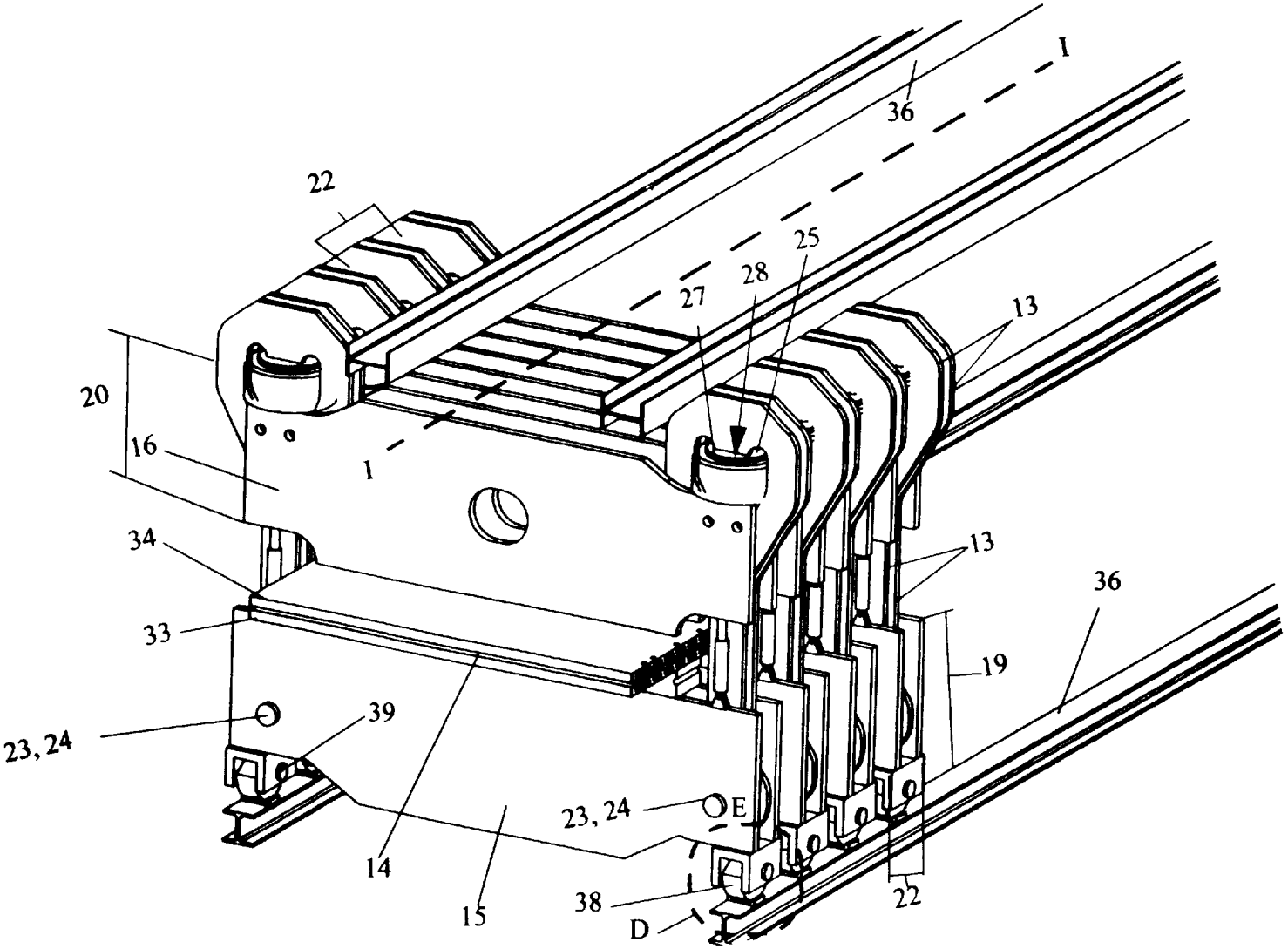
FIG. 2 shows a front part of the continuously operating press in accordance with FIG. 1, on a larger scale, without the entry crossbeam and steel bands.

In accordance with the drawings, the continuously operating press 1 according to the invention comprises, as its main components, upper and lower individual bars 19 and 20 and tensioning brackets 13 connecting them in a positively-locking manner. The tensioning brackets 13 can be released quickly from the lower individual bar 19 via eyelets 23 by means of the bolts 24.

The individual bars 19 and 20 comprise web plates 15 and 16, respectively, and transverse ribs 18 connecting the latter. In each case, two web plates 15 and 16 are connected by means of two tensioning brackets 13 and the openings 25 thereof to form an individual frame 22. Each individual frame 22 is in turn connected in a positively-locking manner over the length of the press to lower and upper press heating plates 33 and 34.

Figure 5:
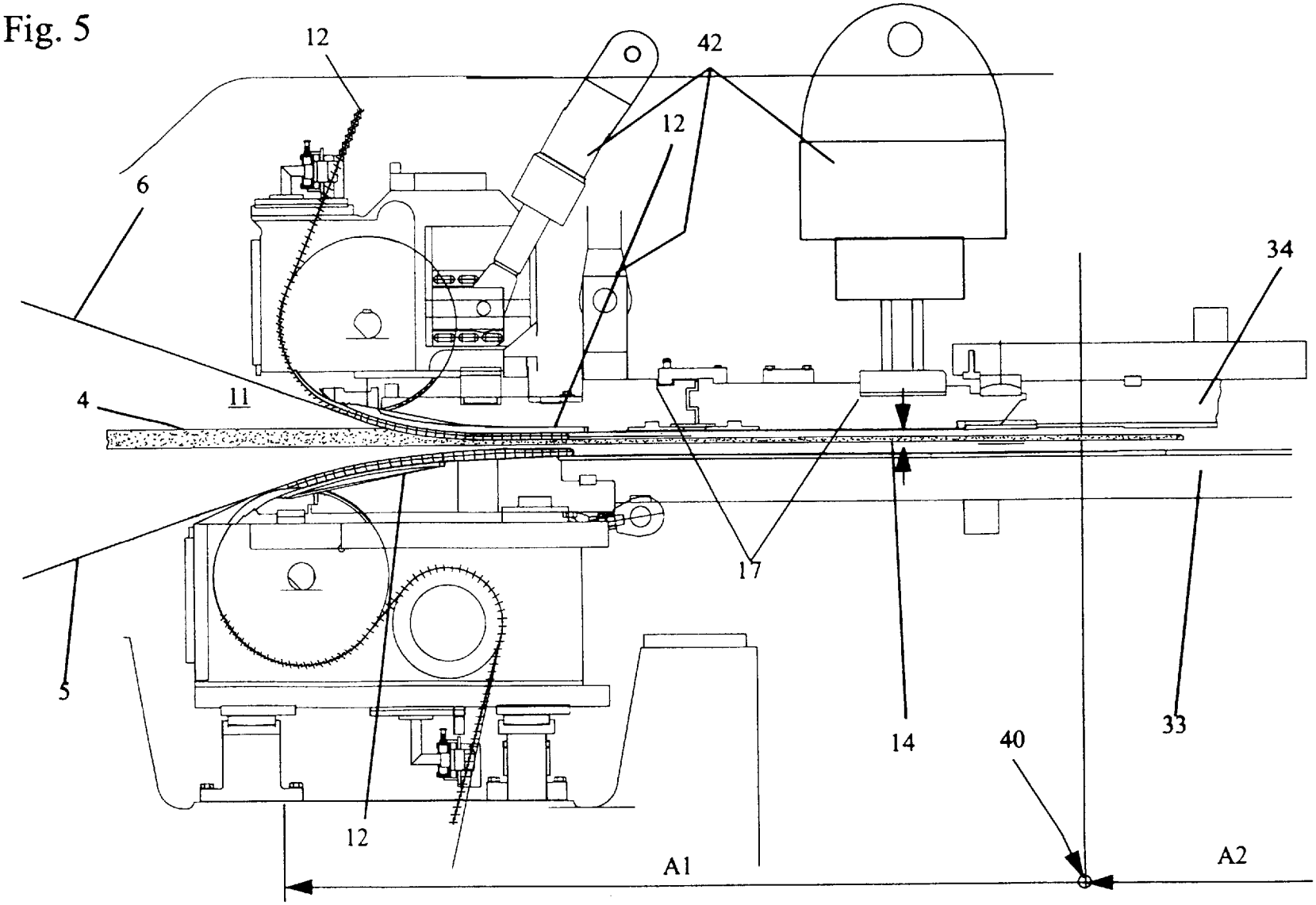
FIG. 5 shows an entry region of the continuously operating press in accordance with FIG. 1.

Entry crossbeams 21 and exit crossbeams 43 are arranged at the end sides of press table 2 and press ram 3, and serve as an anchoring and bearing location for drive rollers 7 and 8, deflecting rollers 9 and 10 and double-jointed entry systems 17 for roll bars 12. It can further be seen from FIGS. 1 and 5 that the deflecting rollers 9 and 10 form the entry nip 11 and the roll bars 12, which are guided with steel bands 5 and 6 around the press table 2 and the press ram 3, and are supported against the press heating plates 33 and 34. That is, the revolving roll bars 12, as an example of a rolling support, are arranged between the press heating plates 33 and 34 and the steel bands 5 and 6 so as to roll along with the steel bands 5 and 6. Furthermore, it is preferred that the press heating plates are attached at one end to the entry crossbeam 21 and at the other end to the exit crossbeam 43.

Figure 3:
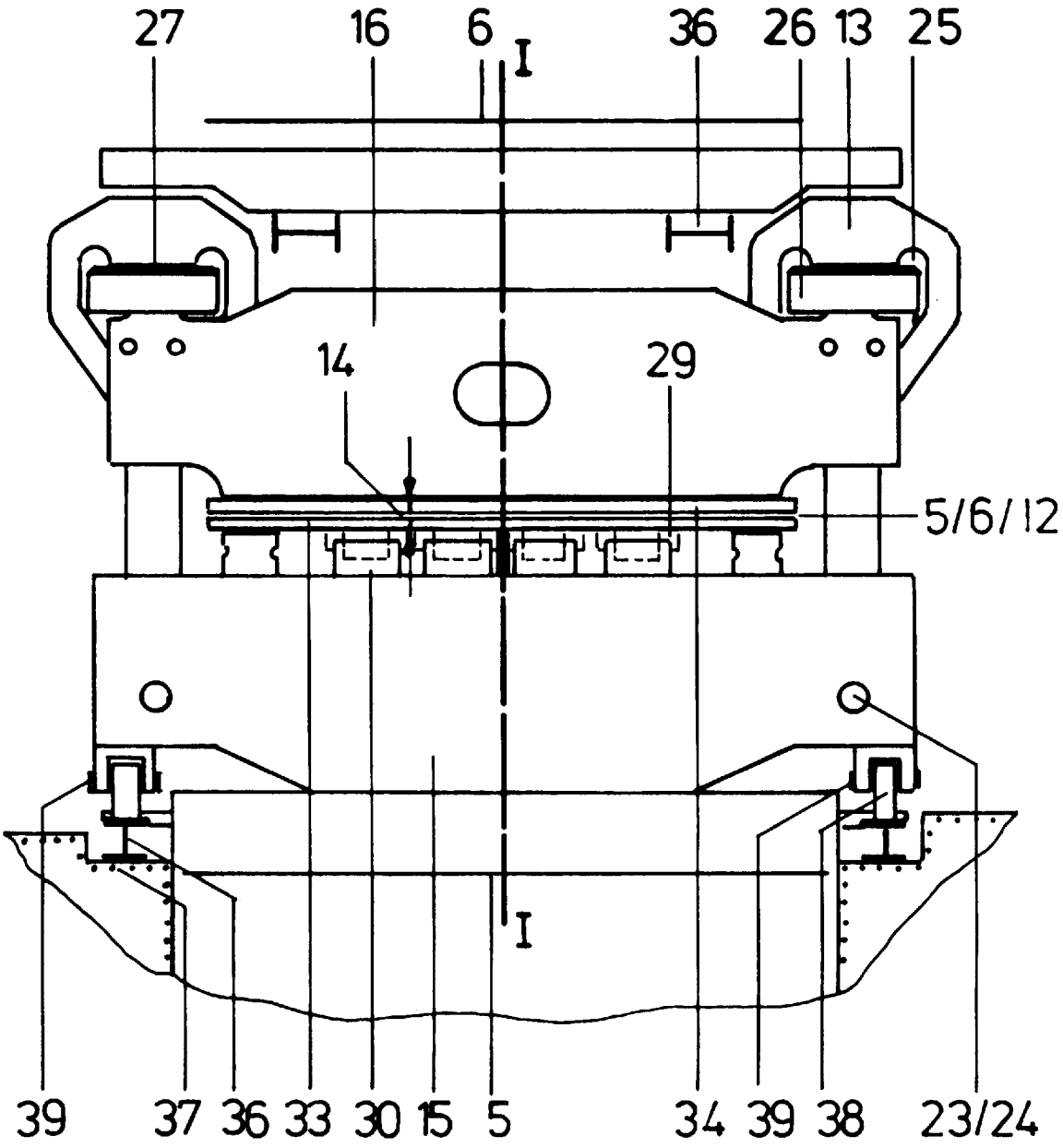
FIG. 3 shows a front view of the continuously operating press in accordance with FIG. 2.
Figure 4:
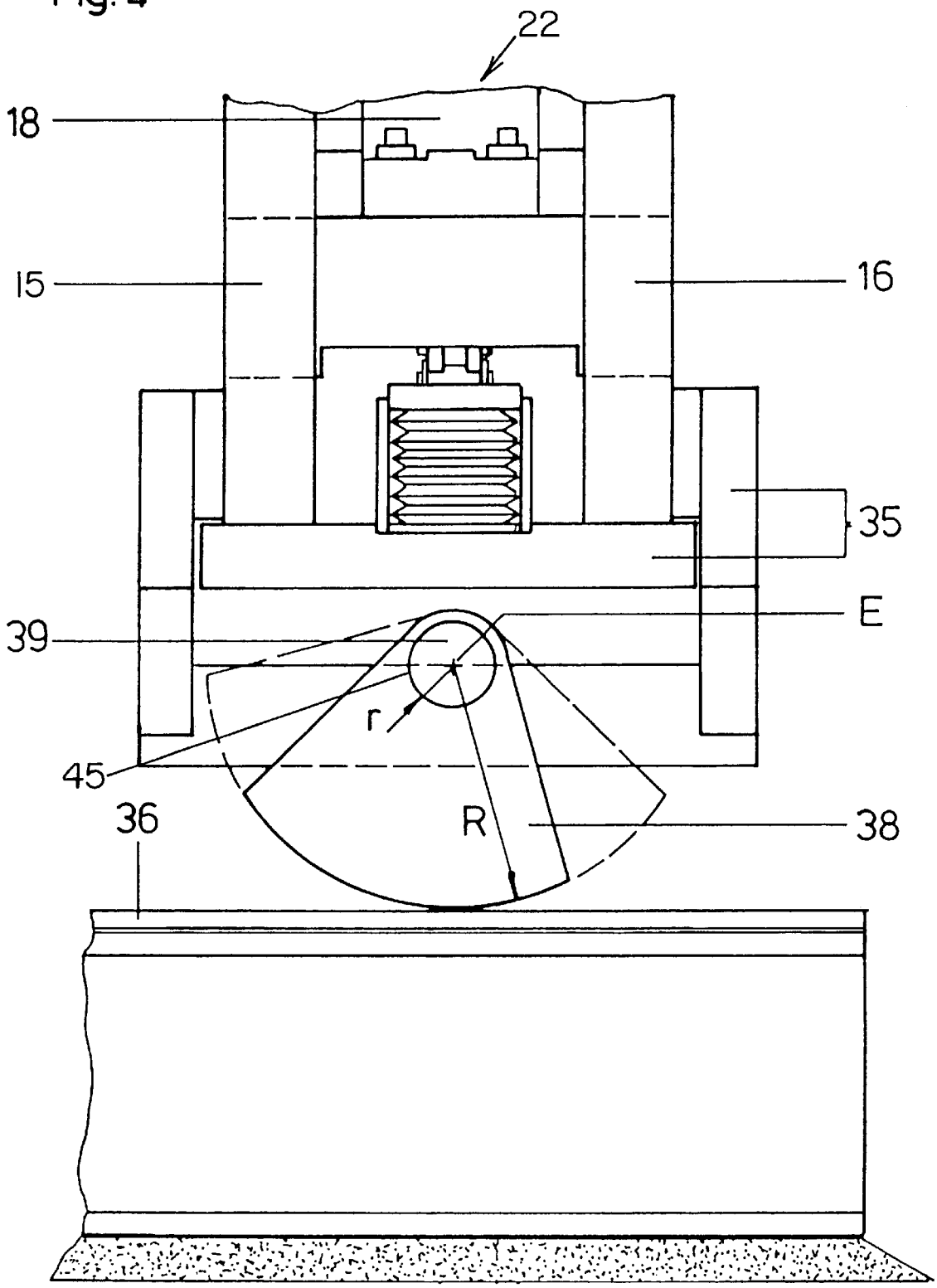
FIG. 4 shows a detail D from FIG. 2 which represents a rolling segment of the continuously operating press.

Material 4 is drawn in through press nip 14 together with the steel bands 5 and 6 (see FIGS. 3 and 5), which are driven by the drive rollers 7 and 8, and is pressed into boards. In order to drive the transverse deformation of the lower press heating plate 33, hydraulic short-stroke cylinders 29 with short-stroke plunger pistons 30 are arranged beneath the press heating plate 33 and assigned to each individual frame 22. The cylinders 29 are supported on web plates 15 of the press table 2.

The preloading forces of the steel bands 5 and 6 between the entry and exit drum systems are expediently taken up as compressive force by four support carriers 36. The individual frames 22 on the two support carriers 36 anchored in the base 37 rest, according to the invention, on rolling wheel segments 38. The rolling wheel segments 38 with sliding pins 39 mounted thereon are each mounted in a supporting structure 35, which is in turn fastened on the lower web plates 15. Rolling wheel segment 38 has a bore with a sliding bearing surface 45, in which sliding pin 39 is mounted.

A thermally fixed reference point 40, located directly behind the double-jointed entry system 17, is provided as a fixing and anchoring point for the press heating plates 33 and 34, so that the double-jointed entry system 17 can be adjusted freely and independently of the thermal expansions of the continuously operating press 1. Since the double-jointed entry system 17 is anchored at the entry cross-beams 21, the entry-crossbeams 21 define the thermally fixed reference point 40. In the event of longitudinal thermal expansion of the upper and lower press heating plates 33 and 34 from room temperature to production temperature, they expand freely from the thermal zero point (or the fixed reference point 40) backwards in the direction of transport. If the production temperature falls, the press 1 contracts in the direction of the fixed reference point 40.

In accordance with the dimensioning rule, the sliding movement in the sliding pin 39 with the radius r and the rolling movement of the rolling wheel segment 38 with the radius R result in a rolling support movement which is adapted to a severe operating mode and is additionally dirt-insensitive on the lower support carrier 36. Technically, this continuously operating press system is divided into two functional paths.

First, there is a front entry region A1, in which a mechanism for on-line adjustment of the press nip 14 with various entry angles is provided. The entry angle in the entry region A1 narrows constantly in the direction of transport with a relatively steep angle gradient.

Second, there is an actual pressing path A2. Within the pressing path A2, the press nip 14 between the press heating plates 33 and 34 changes with a relatively small angle gradient, compared to the entry region A1. At the same time, very high pressures of the press are generated within the pressing path A2 directly after the entry region A1.

Due to the sensitivity of the entry region A1 to the pressing path A2, the thermal fixed reference point 40 for this sliding, continuously operating press 1 is advantageously fixed immediately after the front entry region A1, so that it is not possible for interfering longitudinal movements from the pressing path A2 to affect the entry region A1. The continuously operating press 1 according to the invention is also particularly suitable for an on-the-fly production change in on-line control. As an example, in the event the board thicknesses needs to be varied between 2.5 mm and 38 mm, this requires a change in the temperature in the region of the pressing path of about 30° Celsius, e.g., from 210° Celsius to 240° Celsius. Irrespective of the temperature changes, the individual frames 22 are connected to the press heating plates 33 and 34 at the top and bottom and, in accordance with the elongation due to thermal expansion of the press heating plates 33 and 34, slide on the lower support carriers 36. The individual frames 22 thus move freely between the two upper and the two lower support carriers 36. The support carriers 36 are connected by means of buckling support 41 vertically and horizontally in order to maintain a buckleproof bracing between entry and exit crossbeams 21 and 43.

Furthermore, it can be seen from FIG. 1 that the entry and exit crossbeams 21 and 43, together with the four support carriers 36 and the buckling support 41 thereof, form a closed tented frame 44.

In accordance with FIG. 1, another improvement of the continuously operating press 1 further consists in the fact that the double-jointed entry system 17 can move freely in front of the thermal fixed reference point 40 in the direction of entry crossbeam 21 and, independently of this, hydraulic actuators 42 for the double-jointed entry system 17 carry out the operational movements with regard to controlling the entry angle in the entry region A1.

Other embodiments of the invention will be apparent to those skilled in the art from consideration of the specification and practice of the invention disclosed herein. It is intended that the specification be considered as exemplary only, with the true scope and spirit of the invention being indicated by the following claims.

The entire contents of German patent application DE 196 22 204.4, filed Jun. 3, 1996, are hereby incorporated by reference.

What is claimed is:

1. A continuously operating press comprising:

a press force support structure positioned between upper and lower support carriers, the press force support structure including a plurality of individual frames each having a rolling wheel segment; and upper and lower press heating plates supported on the press force support structure.

2. The press according to claim 1, wherein the rolling wheel segments are supported on the lower support carriers.

3. The press according to claim 2, wherein expansion and contraction of the press heating plates cause spacings between the individual frames to vary.

4. The press according to claim 3, wherein the rolling segments of the individual frames slide on the lower support carriers as the spacings between the individual frames vary.

5. The press according to claim 1, wherein each individual frame further includes a sliding pin such that the sliding pin and the rolling wheel segment rotate about a same rotation point.

6. The press according to claim 5, wherein a rolling frictional resistance of the rolling wheel segment on the lower support carrier is approximately between 0.05 and 0.5.

7. The press according to claim 6, wherein a ratio of the radius of the sliding pin to the radius of the rolling wheel segment is between approximately 0.15 and 0.2.

8. The press according to claim 7, wherein the sliding pin is mounted in a sliding bearing.

9. The press according to claim 1, wherein the press force support structure forms a displaceable unit that is movable with respect to a fixed reference point.

10. The press according to claim 1, wherein each individual frame includes:

top and bottom web plates;

tensioning brackets operably connecting the top and the bottom web plates; and press cylinders that drive a transverse deformation of the lower press heating plates.

11. The press according to claim 1, further comprising an entry crossbeam defining a thermally fixed reference point, and an exit crossbeam, the press heating plates being attached at one end to the entry crossbeam and at the other end to the exit crossbeam.

12. The press according to claim 11, wherein the upper and the lower support carriers include buckling supports therebetween.

13. The press according to claim 12, wherein the upper and the lower support carriers, the buckling supports, the entry crossbeam, and the exit crossbeam form a closed tented frame.

14. The press according to claim 13, further comprising a double-jointed entry system movable to define an entry angle for the press in front of the thermally fixed reference point.

15. The press according to claim 14, further comprising actuators to carry out the movements of the double-jointed entry system.

16. A continuously operating press comprising:

a press force support structure positioned between upper and lower support carriers, the press force support structure including a plurality of individual frames each having a rolling wheel segment;

upper and lower press heating plates supported on the press force support structure; and upper and lower belts having portions arranged between the upper and lower press heating plates, respectively, for conveying material to be pressed.

* * * * *